US009862518B2

(12) United States Patent
Gill et al.

(10) Patent No.: US 9,862,518 B2
(45) Date of Patent: Jan. 9, 2018

(54) PLASTIC CONTAINER WITH IMPROVED SIDEWALL CONFIGURATION

(75) Inventors: Matthew T. Gill, Hellam, PA (US); Justin A. Howell, New Cumberland, PA (US); Anthony J. Schlies, York, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 474 days.

(21) Appl. No.: 12/614,831

(22) Filed: Nov. 9, 2009

(65) Prior Publication Data

US 2011/0108515 A1 May 12, 2011

(51) Int. Cl.

| | |
|---|---|
| ***B65D 1/02*** | (2006.01) |
| ***B65D 79/00*** | (2006.01) |
| ***B65D 90/02*** | (2006.01) |
| ***B65D 6/00*** | (2006.01) |
| ***B65D 8/04*** | (2006.01) |
| ***B65D 8/18*** | (2006.01) |
| ***B65D 85/00*** | (2006.01) |

(52) U.S. Cl.

CPC ..... *B65D 1/0223* (2013.01); *B65D 79/005* (2013.01); *B65D 2501/0036* (2013.01); *B65D 2501/0081* (2013.01)

(58) Field of Classification Search

CPC ..... B65D 1/0261; B65D 79/005; B65D 2501/0027; B65D 2501/0036; B65D 2501/0081; B65D 1/0223

USPC ..... 215/381, 382, 383; 220/669; 206/459.5

See application file for complete search history.

(56) References Cited

U.S. PATENT DOCUMENTS

| | | | | |
|---|---|---|---|---|
| 5,381,910 | A * | 1/1995 | Sugiura et al. | 215/398 |
| 6,213,326 | B1 * | 4/2001 | Denner et al. | 215/383 |
| 6,763,969 | B1 | 7/2004 | Melrose et al. | |
| 6,779,673 | B2 * | 8/2004 | Melrose et al. | 215/381 |
| 6,837,390 | B2 | 1/2005 | Lane et al. | |
| 6,929,138 | B2 | 8/2005 | Melrose et al. | |
| 7,021,479 | B2 * | 4/2006 | Pedmo et al. | 215/381 |
| 7,178,684 | B1 | 2/2007 | Budden et al. | |
| 7,581,654 | B2 * | 9/2009 | Stowitts | B65D 1/0223 215/381 |
| 2006/0131258 | A1 * | 6/2006 | Yourist | B65D 1/0223 215/381 |

(Continued)

OTHER PUBLICATIONS

International Search Report dated Jan. 19, 2011 for corresponding PCT/US2010/054460 filed Oct. 28, 2010.

*Primary Examiner* — Andrew T Kirsch
(74) *Attorney, Agent, or Firm* — Baker Botts L.L.P.

(57) ABSTRACT

A plastic container that is adapted for adjustment to internal volumetric changes such as those that occur during the hot-fill process includes a container body defining an internal space and having a sidewall. The container body has a maximum lateral dimension and a plurality of flexible panels and posts defined in the sidewall. The posts are respectively interposed between the flexible panels around the outer circumference of the sidewall. Each of the plurality of posts has a minimum width and a maximum width, and a ratio of the minimum width to maximum width is preferably within a range of about 0.3 to about 0.7. A ratio of the minimum width to the maximum lateral dimension is preferably within a range of about 0.05 to about 0.30. In addition, a ratio of the maximum width to the maximum lateral dimension is preferably within a range of about 0.15 to about 0.45.

28 Claims, 4 Drawing Sheets

(56) References Cited

U.S. PATENT DOCUMENTS

| | | | | |
|---|---|---|---|---|
| 2006/0186082 | A1 | 8/2006 | Gatewood et al. | |
| 2007/0090083 | A1 | 4/2007 | Trude | |
| 2008/0041811 | A1 | 2/2008 | Stowitts | |
| 2008/0041812 | A1 | 2/2008 | Stowitts | |
| 2010/0012618 | A1* | 1/2010 | Boukobza ..... | B65D 79/005<br>215/383 |

* cited by examiner

PLASTIC CONTAINER WITH IMPROVED SIDEWALL CONFIGURATION

BACKGROUND OF THE INVENTION

1. Field of the Invention

This invention relates generally to the field of plastic containers, and more particularly to plastic containers that are designed to accommodate volumetric expansion and contraction such as that inherent to the hot-fill packaging process or to packaging applications where internal pressurization is anticipated.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

Hot fill containers are designed to be used with the conventional hot fill process in which a liquid or semi-solid product such as fruit juice, sauce, salsa, jelly or fruit salad is introduced into the container while warm or hot, as appropriate, for sanitary packaging of the product. After filling, such containers undergo significant volumetric shrinkage as a result of the cooling of the product within the sealed container. Hot fill type containers accordingly must be designed to have the capability of accommodating such shrinkage. Typically this has been done by incorporating one or more vacuum panels into the side wall of the container that are designed to flex inwardly as the volume of the product within the container decreases as a result of cooling.

Typically, the vacuum panel regions of conventional hot fill containers are characterized by having surfaces that are designed to deflect inwardly when the product within the sealed container undergoes shrinkage. The amount of volumetric contraction, also referred to as vacuum uptake, that can be provided by a conventional vacuum panel is limited by the size of the panel. The design of such containers is often influenced by the aesthetic preferences of manufacturers, which in some instances can limit the size of the vacuum panels to the extent that makes it difficult or impossible to achieve the necessary vacuum uptake capacity.

In certain types of hot-fill containers, the flexible vacuum panels are disposed about the entire circumference of the container sidewall, separated from each other by a corresponding number of posts that are interposed between the vacuum panels. One problem that has afflicted many conventional hot-fill container designs of this type is uneven or asymmetric deflection of the different vacuum panels under vacuum uptake conditions. The possibility of such inconsistent deformation makes it difficult to reliably design a container having the desired amount of vacuum uptake capability, and it is also unsightly.

A need therefore exists for an improved vacuum panel configuration that achieves a maximal amount of reliability in terms of vacuum panel deflection under vacuum uptake conditions.

SUMMARY OF THE INVENTION

Accordingly, it is an object of the invention to provide an improved vacuum panel configuration that achieves a maximal amount of reliability in terms of vacuum panel deflection under vacuum uptake conditions.

In order to achieve the above and other objects of the invention, a plastic container that is adapted for adjustment to internal volumetric changes according to a first aspect of the invention includes a container body defining an internal space. The container body has a maximum lateral dimension and a sidewall comprising a plurality of flexible panels and a corresponding plurality of posts. The posts are respectively interposed between the flexible panels. Each of the plurality of posts has a minimum width and a maximum width, and a ratio of the minimum width to the maximum width is within a range of about 0.30 to about 0.70.

A plastic container according to a second aspect of the invention is adapted for adjustment to internal volumetric changes and includes a container body defining an internal space. The container body has a maximum lateral dimension and a sidewall comprising a plurality of flexible panels and a corresponding plurality of posts. The posts are respectively interposed between the flexible panels. Each of the plurality of posts has a minimum width, and a ratio of the minimum width to the maximum lateral dimension is within a range of about 0.05 to about 0.30.

A plastic container according to a third aspect of the invention is adapted for adjustment to internal volumetric changes and includes a container body defining an internal space. The container body has a maximum lateral dimension and a sidewall comprising a plurality of flexible panels and a corresponding plurality of posts. The posts are respectively interposed between the flexible panels. Each of the plurality of posts has a maximum width, and a ratio of the maximum width to the maximum lateral dimension is within a range of about 0.15 to about 0.45.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
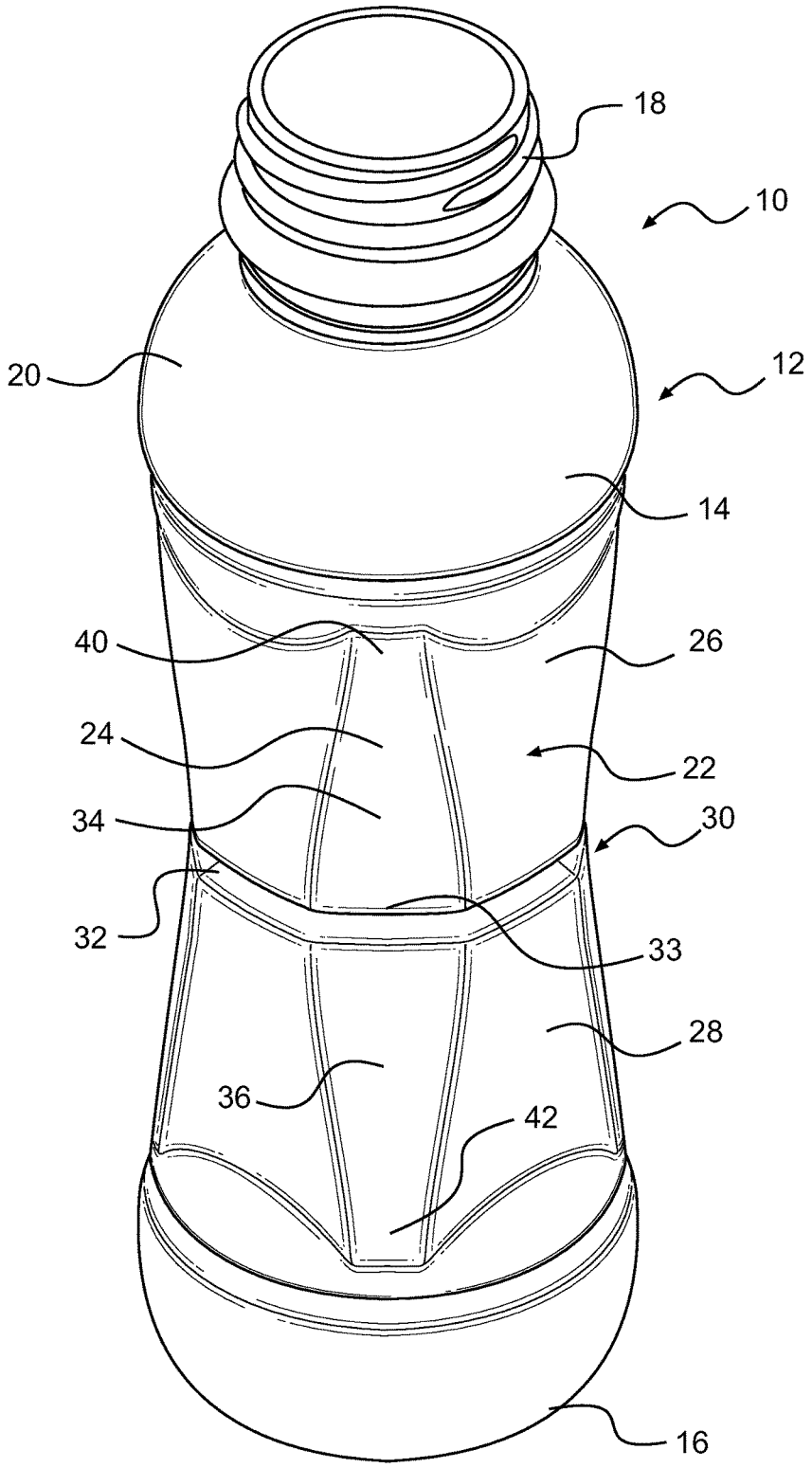
FIG. 1 is a perspective view of a container that is constructed according to a preferred embodiment of the invention.

Referring now to the drawings, wherein like reference numerals designate corresponding structure throughout the views, and referring in particular to FIG. 1, a plastic container 10 that is constructed according to a preferred embodiment of the invention includes a container body 12 having a sidewall 14, a bottom portion 16 and a threaded finish portion 18.

Plastic container 10 is preferably of unitary construction and is preferably fabricated from a plastic material such as polyethylene terephthalate (PET) using a conventional molding process such as the reheat stretch blow molding process.

Plastic container 10 is adapted for adjustment to internal volumetric changes, such as those that occur during the well-known hot-fill process.

In the preferred embodiment, container body 12 includes a rounded upper dome portion 20 having an outer surface that is substantially circular as viewed in transverse cross-section and that defines at a lower portion thereof a maximum lateral dimension or diameter $D_{MAX}$ of the container 10. Alternatively, the container could be structured so that the maximum lateral dimension is at a different location.

The sidewall 14 of the container body 12 preferably includes a plurality of flexible vacuum panels 22 and a corresponding plurality of posts 24. In the preferred embodiment, the posts 24 are respectively interposed between the flexible panels 22 about the entire circumference of the container body 12. Preferably, each of the vacuum panels 22 includes an upper panel portion 26 and a lower panel portion 28. The upper and lower panel portions 26, 28 are separated by a discontinuity 30 in the sidewall 14 that in the preferred embodiment is a circumferential groove 32 that is oriented so as to reside within a plane that is transverse to a longitudinal axis of the container 10.

Figure 6:
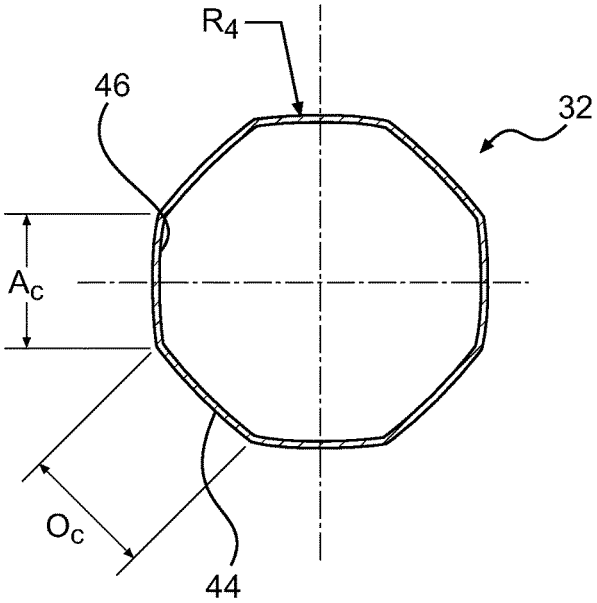
FIG. 6 is a cross-sectional view taken along lines 6-6 in FIG. 2.

The posts 24 are also divided in the preferred embodiment into upper post portions 34 and lower posts portions 36 by the discontinuity 30. In this embodiment, the discontinuity 30 is constructed as a concave, inwardly extending groove 32 that is defined in the sidewall 14. As shown in FIG. 6, the groove 32 as viewed in transverse cross-section has a inwardmost surface that is generally octagonal in shape, with each of the sides preferably having substantially the same length.

The groove 32 in the preferred embodiment has four sides that are aligned with the flexible vacuum panels 22 and that have a length $A_C$, and four sides that are aligned with the posts 24 and that have a length $O_C$ that is preferably substantially the same as length $A_C$. In the preferred embodiment, lengths $O_C$ and $A_C$ are preferably within a range of about 0.25 to about 0.30 as a ratio with respect to the maximum lateral dimension $D_{MAX}$ of the container 10.

Each of the sides is preferably slightly convex, having a radius of curvature $R_2$ that is preferably within a range of 0.1 to about 1.0.

Each of the posts 24 in the preferred embodiment has a minimum width $O_{MIN}$ as viewed in side elevation and a maximum width $O_{MAX}$, also as viewed in side elevation. A ratio of the minimum width $O_{MIN}$ to the maximum width $O_{MAX}$ is preferably within a range of about 0.3 to about 0.7, more preferably within a range of about 0.4 to about 0.6, and most preferably within a range of about 0.5 to about 0.55.

Figure 2:
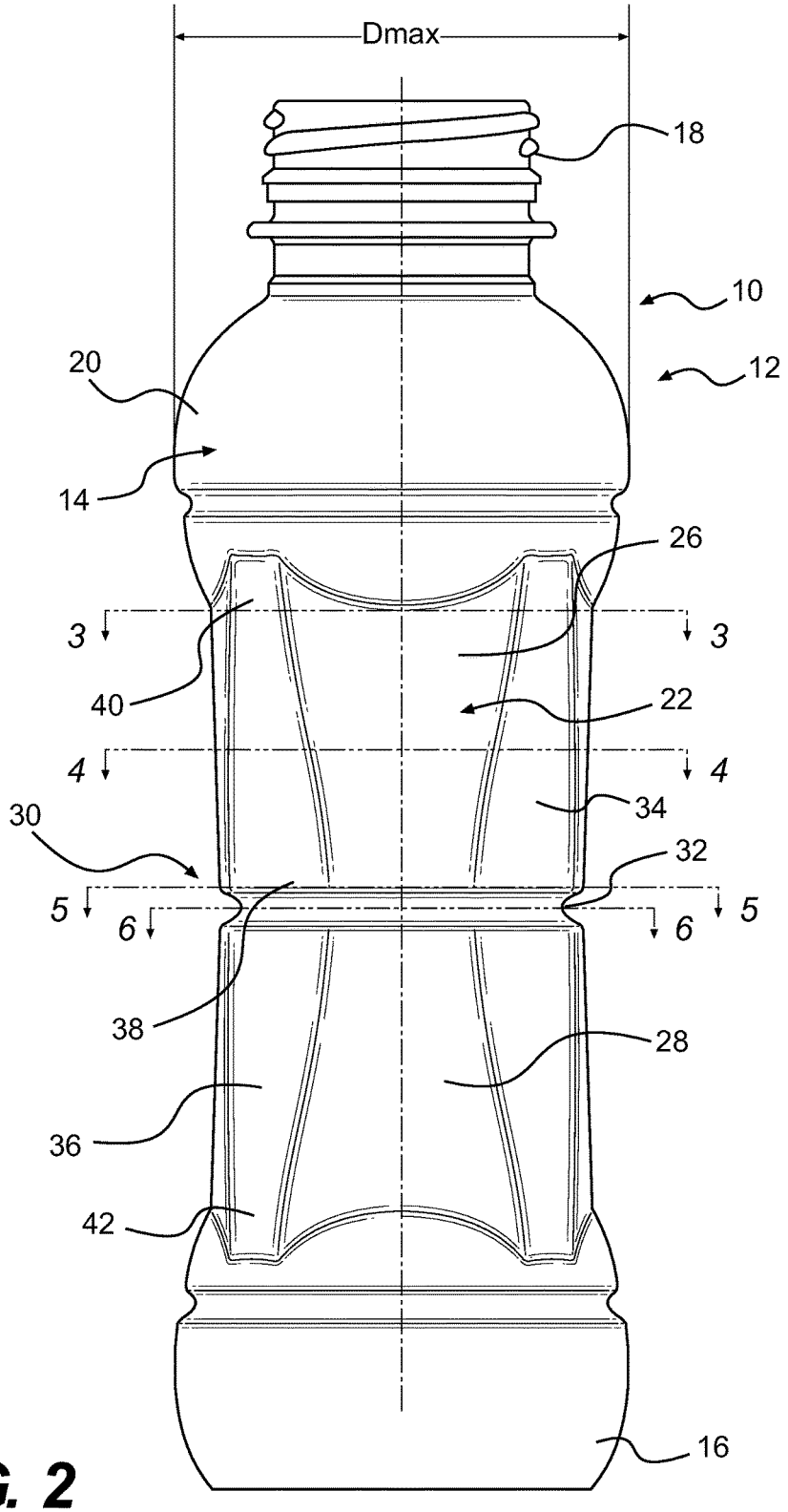
FIG. 2 is a side elevational view of the container shown in FIG. 1.

As is best shown in FIGS. 1 and 2, each of the plurality of posts 24 in the preferred embodiment is tapered as viewed in side elevation. Each of a plurality of posts 24 has a mid portion 38, an upper distal portion 40 and a lower distal portion 42, and is shaped so as to be wider when viewed in side elevation as shown in FIG. 2 at the mid portion 38 than at least one of the upper and lower distal portions 40, 42. In the preferred embodiment, all of the posts 24 have substantially the same shape and dimensions, and are shaped so as to be wider at their mid portions 38 than at both of their respective upper and lower distal portions 40, 42.

Figure 3:
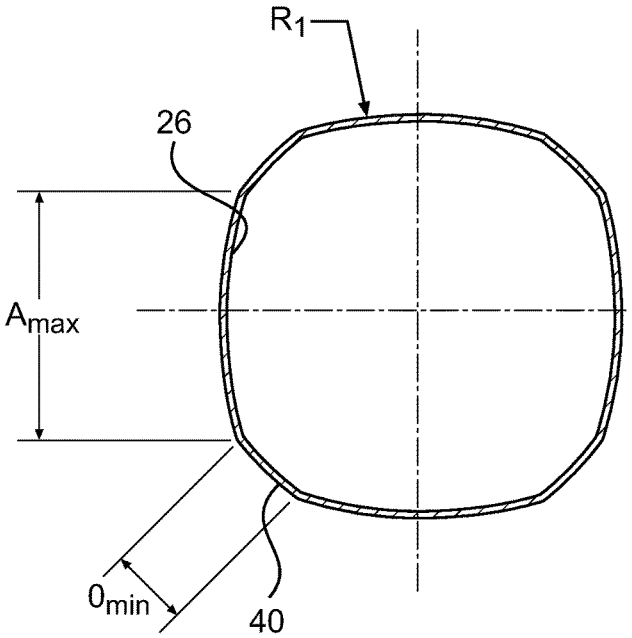
FIG. 3 is a cross-sectional view taken along lines 3-3 in FIG. 2.
Figure 4:
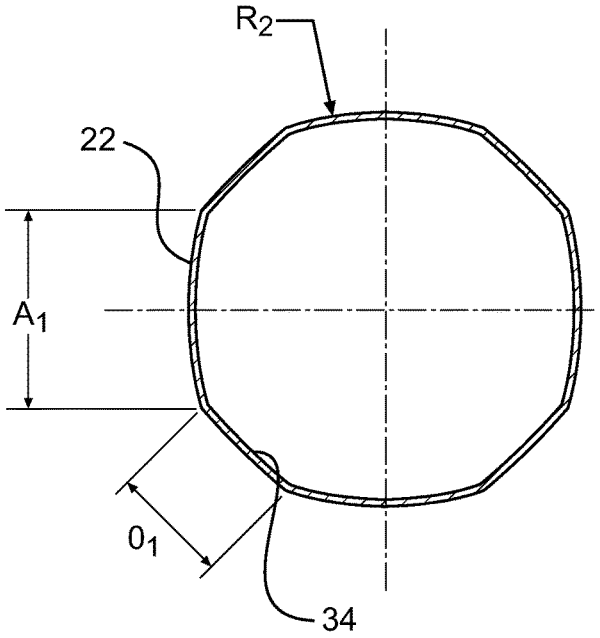
FIG. 4 is a cross-sectional view taken along lines 4-4 in FIG. 2.
Figure 5:
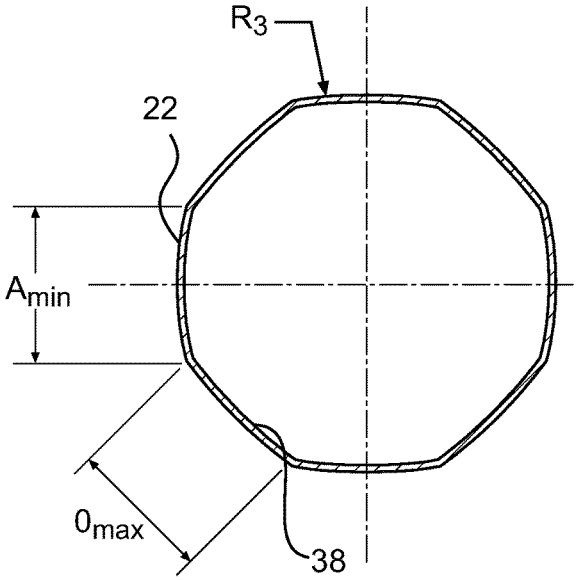
FIG. 5 is a cross-sectional view taken along lines 5-5 in FIG. 2.

The minimum width $O_{MIN}$ of each of the posts 24, shown in cross-section in FIG. 3, is preferably located substantially at the upper distal portion 40, with a corresponding minimum width being located substantially at the lower distal portion 42. A maximum width $O_{MAX}$ of each of the posts 24, shown in cross-section in FIG. 5, is preferably located near the mid portion 38, immediately adjacent to the groove 32. FIG. 4 is a transverse cross-sectional view taken at an intermediate location between the mid portion 38 and the upper distal portion 40. It shows an intermediate width $O_1$ that is preferably greater than the minimum width $O_{MIN}$ and less than the maximum width $O_{MAX}$.

A ratio of the minimum post width $O_{MIN}$ to the maximum lateral dimension $D_{MAX}$ of the container 10 is preferably within a range of about 0.05 to about 0.30, more preferably within a range of about 0.075 to about 0.25, and most preferably within a range of about 0.1 to about 0.2.

A ratio of the maximum post width $O_{MAX}$ to the maximum lateral dimension $D_{MAX}$ is preferably within a range of about 0.15 to about 0.45, more preferably within a range of about 0.175 to about 0.4, and most preferably within a range of about 0.2 to about 0.35.

The flexible panels 22 are generally complementary in shape to the posts 24, and in the preferred embodiment are generally hourglass-shaped. As shown in FIG. 3, a maximum panel width $A_{MAX}$ is located near the top of the upper panel portion 26, within a common transverse plane as the minimum post width $O_{MIN}$. Within this transverse plane, the vacuum panel 22 preferably is slightly convex and has a radius of curvature $R_1$.

A minimum panel width $A_{MIN}$, shown in FIG. 5, is preferably located near the bottom of the upper panel portion 26, within a common transverse plane as the maximum post width $O_{MAX}$. Within this transverse plane, the vacuum panel 22 preferably is slightly convex and has a radius of curvature $R_3$.

FIG. 4 is a transverse cross-sectional view taken at an intermediate location within the upper panel portion 26. It shows an intermediate panel width $A_1$ that is preferably greater than the minimum panel width $A_{MIN}$ and less than the maximum panel width $A_{MAX}$. Within this transverse plane, the vacuum panel 22 preferably is slightly convex and has a radius of curvature $R_2$. Radii $R_1$, $R_2$ and $R_3$ are preferably substantially equal.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container adapted for adjustment to internal volumetric changes, comprising:

a container body defining an internal space, said container body having a maximum lateral dimension and a sidewall comprising a plurality of flexible panels configured for vacuum uptake of the internal space and a corresponding plurality of posts, said posts being respectively interposed between said flexible panels;

wherein each of the plurality of posts has a convex transverse cross section and comprises an upper post portion and a lower post portion, the upper post portion and lower post portion of each post being tapered from a maximum post width to a minimum post width in side elevation as defined by opposing first and second lateral boundaries;

wherein each of the plurality of flexible panels is generally convex in transverse cross section and generally hourglass-shaped in side elevation and comprises an upper panel portion, a lower panel portion, and an intermediate portion between the upper panel portion and the lower panel portion; and wherein each of the plurality of flexible panels has a maximum panel width and a minimum panel width in side elevation, the maximum panel width of each of the plurality of flexible panels is located at an uppermost end of the upper panel portion and at a lowermost end of the lower panel portion, and the minimum panel width located proximate the intermediate portion.

2. A plastic container according to claim 1, wherein the minimum post width in side elevation is defined as a minimum distance between the first and second lateral boundaries, and wherein a ratio of said minimum post width to said maximum lateral dimension is within a range of about 0.05 to about 0.30.

3. A plastic container according to claim 2, wherein said ratio of said minimum post width to said maximum lateral dimension is within a range of about 0.10 to about 0.20.

4. A plastic container according to claim 1, wherein each of said plurality of posts has a mid portion, an upper distal end portion and a lower distal end portion, and is shaped so as to be wider in side elevation at said mid portion than at least one of said upper and lower distal end portions.

5. A plastic container according to claim 4, wherein each of said plurality of posts is shaped so as to be wider in side elevation at said mid portion than at both of said upper and lower distal end portions.

6. A plastic container according to claim 1, wherein said sidewall further comprises a discontinuity extending circumferentially about a longitudinal mid portion of said container body.

7. A plastic container according to claim 6, wherein said discontinuity comprises a groove defined in said sidewall.

8. A plastic container according to claim 7, wherein said groove is substantially octagonal as viewed in transverse cross section.

9. A plastic container according to claim 7, wherein said lower panel portion has an upper boundary defined along a bottom edge of the groove and the upper panel portion has a lower boundary defined along a top edge of the groove.

10. A plastic container according to claim 1, wherein a ratio of said maximum panel width in side elevation to said maximum lateral dimension is within a range of about 0.15 to about 0.45.

11. A plastic container according to claim 1, wherein each upper panel portion tapers continuously from the maximum panel width to the minimum panel width.

12. A plastic container adapted for adjustment to internal volumetric changes, comprising:

a container body defining an internal space, said container body having a maximum lateral dimension and a sidewall comprising a plurality of flexible panels configured for vacuum uptake of the internal space and a corresponding plurality of posts, said posts being respectively interposed between said flexible panels;

wherein each of said plurality of flexible panels is generally convex in transverse cross section and generally hourglass-shaped in side elevation and comprises an upper panel portion, a lower panel portion, and an intermediate portion between the upper panel portion and the lower panel portion, wherein each of the plurality of flexible panels has a maximum panel width and a minimum panel width in side elevation, the maximum panel width of each of the plurality of flexible panels located at an uppermost end of the upper panel portion and at a lowermost end of the lower panel portion, and the minimum panel width located proximate the intermediate portion; and wherein each of said plurality of posts has a convex transverse cross section and comprises an upper post portion and a lower post portion, the upper post portion and lower post portion of each post defined by opposing first and second lateral boundaries; and wherein each of said plurality of posts has a minimum post width and a maximum post width in side elevation, the maximum post width of each post defined as a maximum distance between the first and second lateral boundaries and the minimum post width of each post defined as a minimum distance between the first and second lateral boundaries, wherein a ratio of said minimum post width to said maximum post width is within a range of about 0.30 to about 0.70.

13. A plastic container according to claim 12, wherein a ratio of said minimum post width to said maximum post width is within a range of about 0.40 to about 0.60.

14. A plastic container according to claim 13, wherein said ratio of said minimum post width to said maximum post width is within a range of about 0.5 to about 0.55.

15. A plastic container according to claim 12, wherein each of said plurality of posts has a mid portion, an upper distal end portion and a lower distal end portion, and is shaped so as to be wider when viewed in side elevation at said mid portion than at least one of said upper and lower distal end portions.

16. A plastic container according to claim 15, wherein each of said plurality of posts is shaped so as to be wider when viewed in side elevation at said mid portion than at both of said upper and lower distal end portions.

17. A plastic container according to claim 12, wherein said sidewall further comprises a discontinuity extending circumferentially about a longitudinal mid portion of said container body.

18. A plastic container according to claim 17, wherein said discontinuity comprises a groove defined in said sidewall.

19. A plastic container according to claim 18, wherein said groove is substantially octagonal as viewed in transverse cross section.

20. A plastic container according to claim 12, wherein a ratio of said minimum post width to said maximum lateral dimension is within a range of about 0.05 to about 0.30.

21. A plastic container according to claim 12, wherein a ratio of said maximum post width to said maximum lateral dimension is within a range of about 0.15 to about 0.45.

22. A plastic container according to claim 12, each upper panel portion having a top boundary with an upwardly facing concave shape and each lower panel portion having a lower boundary with a downwardly facing concave shape.

23. A plastic container adapted for adjustment to internal volumetric changes, comprising:

a container body defining an internal space, said container body having a maximum lateral dimension and a sidewall comprising a plurality of flexible panels configured for vacuum uptake of the internal space and a corresponding plurality of posts, said posts being respectively interposed between said flexible panels;

each post comprising an upper post portion and a lower post portion, each upper post portion and lower post portion being vertically tapered from a maximum post width to a minimum post width as defined by opposing first and second lateral boundaries in side elevation, wherein the maximum post width in side elevation is defined as a maximum distance between the first and second lateral boundaries and the minimum post width in side elevation is defined as a minimum distance between the first and second lateral boundaries, wherein a ratio of said minimum post width to said maximum post width is within a range of about 0.30 to about 0.70;

wherein each of the plurality of flexible panels is generally convex in transverse cross section and generally hourglass-shaped in side elevation and comprises an upper panel portion, a lower panel portion, and an intermediate portion between the upper panel portion and the lower panel portion; and wherein each of the plurality of flexible panels has a maximum panel width and a minimum panel width in side elevation, the maximum panel width of each of the plurality of flexible panels located at an uppermost end of the upper panel portion and at a lowermost end of the lower panel portion, and the minimum panel width located proximate the intermediate portion, wherein each upper panel portion and each lower panel portion tapers continuously from the maximum panel width to the minimum panel width.

24. A plastic container according to claim 23, wherein a ratio of said maximum post width to said maximum lateral dimension is within a range of about 0.15 to about 0.45.

25. A plastic container according to claim 24, wherein said ratio of said maximum post width to said maximum lateral dimension is within a range of about 0.20 to about 0.35.

26. A plastic container according to claim 23, wherein said sidewall further comprises a discontinuity extending circumferentially about a longitudinal mid portion of said container body.

27. A plastic container according to claim 26, wherein said discontinuity comprises a groove defined in said sidewall.

28. A plastic container according to claim 27, wherein said groove is substantially octagonal as viewed in transverse cross section.

* * * * *